United States Patent [19]

Rodewald et al.

[11] 4,388,172

[45] Jun. 14, 1983

[54] LIQUEFACTION OF COAL

[75] Inventors: Bernhard Rodewald, Mannheim; Kurt Tippmer; Hans F. Tamm, both of Recklinghausen, all of Fed. Rep. of Germany

[73] Assignee: Ruhrkohle Aktiengesellschaft, Fed. Rep. of Germany

[21] Appl. No.: 306,687

[22] Filed: Sep. 29, 1981

[30] Foreign Application Priority Data

Oct. 10, 1980 [DE] Fed. Rep. of Germany ..... 3038309

[51] Int. Cl.[3] ..... C10G 1/06

[52] U.S. Cl. ..... 208/10; 208/47

[58] Field of Search ..... 208/10, 47

[56] References Cited

U.S. PATENT DOCUMENTS 1,852,988 4/1932 Varga ..... 208/10

2,221,952 11/1940 Pier et al. ..... 208/47

FOREIGN PATENT DOCUMENTS 432958 8/1935 United Kingdom ..... 208/47

447210 5/1936 United Kingdom ..... 208/47

OTHER PUBLICATIONS

Kirk-Othmer, "Sulfur (Sulfur Compounds)" in *Encyclopedia of Chemical Technology*, 2nd Ed. (1963), vol. 19, pp. 376-377.

Thorpe, "Sodium" in *Thorpe's Dictionary of Applied Chemistry*, 4th Ed. (1937), vol. 10, pp. 890-891.

*Primary Examiner*—Delbert E. Gantz

*Assistant Examiner*—Lance Johnson

*Attorney, Agent, or Firm*—Jordan B. Bierman; Linda Bierman

[57] ABSTRACT

In a method for the liquefaction of coal which has chlorine-containing compounds therein, which method comprises the hydrogenation of the coal in the presence of a catalyst, the improvement which comprises neutralizing the compounds with an alkali metal hydrogen sulfide whereby $H_2S$ is produced. In a preferred form of the invention, the $H_2S$ is reacted with an alkali metal hydroxide to produce the alkali metal hydrogen sulfide which, in turn, is recycled into the hydrogenation step.

8 Claims, 1 Drawing Figure

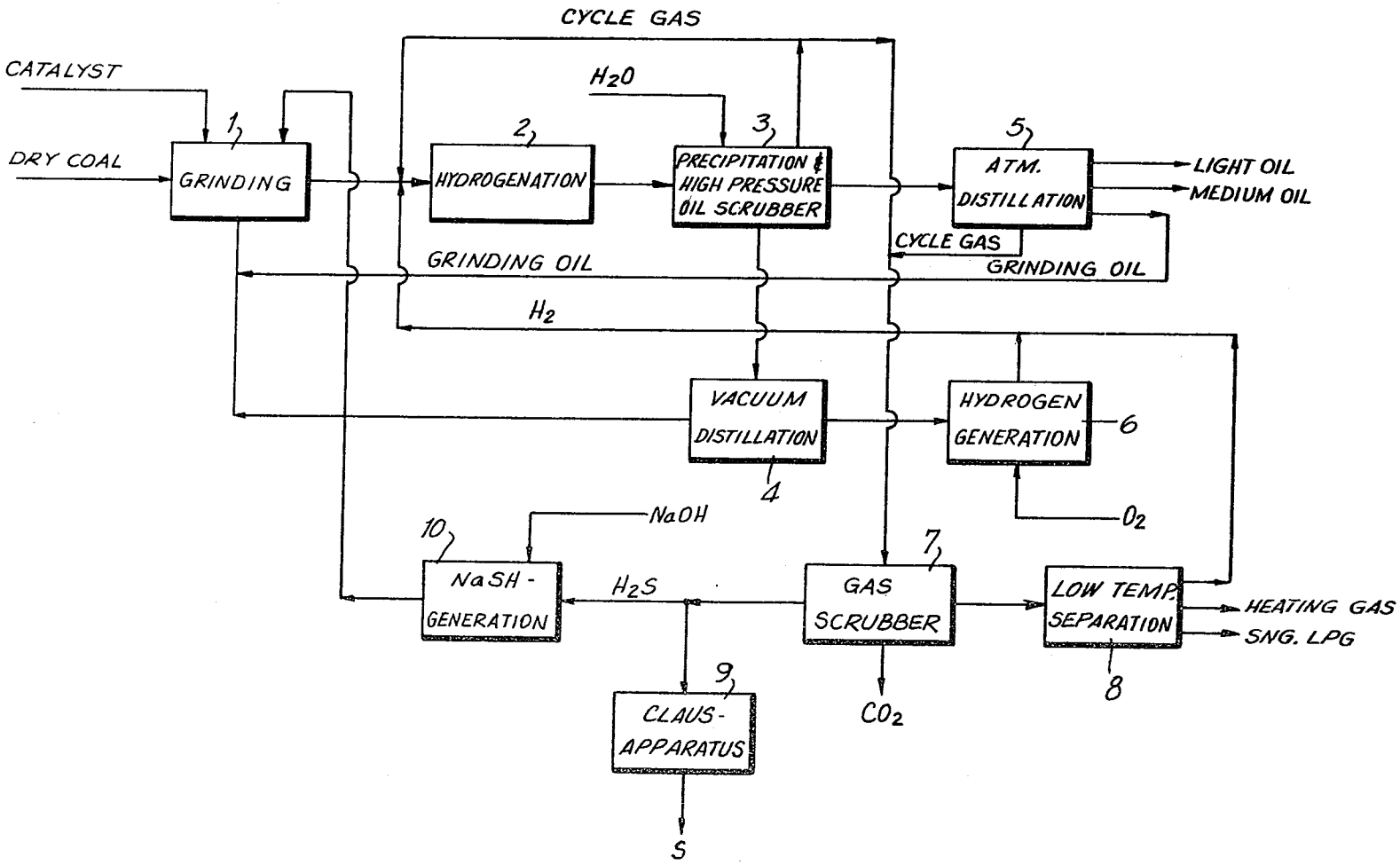
CATALYST
DRY COAL
1
GRINDING
2
HYDROGENATION
$H_2O$
CYCLE GAS
3
PRECIPITATION & HIGH PRESSURE OIL SCRUBBER
5
ATM. DISTILLATION
LIGHT OIL
MEDIUM OIL
CYCLE GAS
GRINDING OIL
GRINDING OIL
$H_2$
4
VACUUM DISTILLATION
6
HYDROGEN GENERATION
$O_2$
7
GAS SCRUBBER
$CO_2$
8
LOW TEMP. SEPARATION
HEATING GAS
SNG. LPG
NaOH
$H_2S$
10
NaSH - GENERATION
9
CLAUS-APPARATUS
S

LIQUEFACTION OF COAL

This application claims the benefit of the priority of German Application P 30 38 309.6, filed Oct. 10, 1981.

The present invention is directed to a method for the liquefaction of coal; in particular, coal which has therein chlorine-containing compounds.

Coal liquefaction as such has been known for some time. In broad outline, the ground coal is mixed with an oil and a catalyst and introduced into high pressure reactors at about 700 bar and 450° to 480° C. Molecular hydrogen is also added, and oils of different boiling points and hydrocarbon gases are produced. The separation of solids such as coal ash, residual coal, and catalyst is carried out by means of centrifuges. The asphaltene-containing overflow was returned to the initial ground coal as a suspending medium. The remainder of the medium consisted of the higher-boiling oils which are the product of the distillation step.

This known technique has undergone an essential further development in the separation of the solids from the hydrogenation products by distillation, the recycling of distillate oils for the coal meshing, and hence reduction of the asphaltenes in the hydrogenation reactor, and in the utilization of the vacuum residue of the distillation step for the production of hydrogen in an after-connected gasification step.

In essence, a problem with this method exists when the coal has chlorine-containing compounds. These appear with some frequency, usually in amounts of 0.05 to 0.1% by weight. This chlorine is liberated in the hydrogenation reactor under the elevated temperatures and pressures which exist there. As a result, the precipitators which are located immediately downstream of the hydrogenator are subject to substantial corrosion, especially after the dew point has been reached.

In order to overcome this problem, small quantities (about 0.3% by weight) of sodium sulfide have been added in order to neutralize the chlorine. This is usually in solid form, and the chlorine is thereafter bound as sodium chloride and drawn off with the sump product of the precipitator. The sodium sulfide is a raw material which must be independently purchased.

It is, therefore, an object of the present invention to reduce the cost engendered by the use of sodium sulfide. In practicing the present invention, there is provided, instead of sodium sulfide, alkali metal hydrogen sulfide. This latter compound can be easily prepared by saturating an alkali metal hydroxide with hydrogen sulfide. Preferably, sodium or potassium hydroxide is used, the most preferred being sodium hydroxide. The hydrogen sulfide is provided directly from the hydrogenation system by using the existing acid gas stream of the gas scrubber. Under these circumstances, the sodium hydrogen sulfide can be used in the liquid phase without transforming it to the solid state.

The accompanying Drawing sets forth a flow diagram of the present process. The process will now be described with reference to the Drawing, but it is understood that this is intended to be exemplary only and not limitative.

Anthracite is preferably first brought to an ash content of 4 to 6% by mechanical treatment. The water content is advantageously 1 to 2%. This material is mixed with the cycled oil and ground in crusher 1. A rotating mill with a light grinding body has been found suitable for this purpose. This grinding preferably pulverizes the coal so that 60% of the grains are less than 60 microns in size. The sodium hydrogen sulfide and the catalyst are usually added to the coal as it enters the grinder.

The mix, together with hydrogen and cycle gas, are introduced into hydrogenation step 2 and are heated to 425° C. The reaction advantageously takes place in three reactors, in series, and produces a mixture of products which are then introduced into precipitator and high pressure oil scrubber 3.

In precipitator 3, the reaction mixture is separated into a gas/vapor phase and a liquid/solid phase. The former is cooled, and the oil which condenses is subjected to atmospheric distillation 5. The gas is put through the oil scrubber which removes substantial quantities of the $C_1$ to $C_5$ hydrocarbons which are present. As a result, the percentage of hydrogen is enriched to at least 80%. The greater part of the washed gas forms the cycled gas. The remainder of the gas fraction is introduced into gas scrubber 7. The liquid/solid phase from precipitator 3 is, subjected to vacuum distillation 4.

Thus, from the precipitator and high pressure oil scrubber come (1) cycled gas which is returned to hydrogenation step 2, (2) solids which are sent to vacuum distillation 4, and (3) oil which is subjected to atmospheric distillation 5.

Atmospheric distillation 5 receives the coal oils and permits them to expand to near atmospheric pressure. This causes the discharge of the dissolved light hydrocarbons and the dissolved hydrogen. A heater supplies the necessary heat for distillation and the column separates the coal oil into light, medium, and heavy oil fractions. The heavy oil fraction together with a part of the medium oil fraction is mixed with the dry coal which is the raw material of the process. The gases are scrubbed and then introduced into low temperature fractionator 8.

The liquid/solid fraction is introduced into vacuum distillation column 4. The vapors formed as a result of the expansion from 300 bar to 7 bar (at 450° C.) are condensed and are added, together with the heavy oil (which is one of the products of vacuum distillation 4), to the dry coal as part of the oil at the atmospheric distillation as described above. The vacuum residue, comprising 60% heavy oil and 40% solids (unreacted coal, ash, and catalyst) can be pumped and is conveyed thereby to hydrogen generator 6.

In hydrogen generator 6, the vacuum residue is subjected to partial oxidation with oxygen and steam under pressure. The gasification reactions proceed at an average temperature of approximately 1,500° C. and the pressure tank is lined with special refractory bricks. The synthesis gas and the liquid slag pass through a constriction in the lower part of the reactor into a quencher (not shown).

At that point, the slag and fine dust are separated and are transported to a dump. The synthesis gas becomes partially steam saturated and the saturation is completed in a subsequent spray column. Thereafter, the last solid particles are removed from the synthesis gas by a venturi scrubber. The purified synthesis gas is then sent to the carbon monoxide converter.

In the converter, the carbon monoxide component of the gas is reacted with steam to form hydrogen and carbon dioxide. The reactors are preferably equipped with a sulfur-proof catalyst. The converted gas is cooled and transferred to a $H_2S$-$CO_2$ remover.

In the remover, the hydrogen sulfide and carbon dioxide are washed out of the gas stream by means of an activated potash solution. The gas flows through a Pressure Swing Adsorption (PSA) system and the final purification occurs therein by adsorption. The hydrogen passes through unhindered and can thus be obtained in great purity for use in the hydrogenation step.

Gas scrubber 7 is preferably a two stage process. In the first stage, methanol, which has been saturated with $CO_2$ is used as the scrubbing medium. This absorbs the sulfur components and leaves only the carbon dioxide. In the second stage, the carbon dioxide is removed.

The enriched solvent from the first stage is subjected to expansion and heat by which the hydrogen sulfide is removed. It is then sent to the sodium hydrogen sulfide generator or the Claus system. The solvent, which is now free from hydrogen sulfide, together with the regenerated solvent from the $CO_2$ desorber is fed into the second stage. In addition, partially regenerated solvent is introduced into the bottom part of the second stage for substantial removal of the carbon dioxide from the gas. The rich solvent from the second stage is regenerated in the desorber by expansion and nitrogen stripping. The solvent for removing the hydrogen sulfide is taken from the carbon dioxide regenerator and pumped into the head portion of the first stage.

The portion of the cycled gas which has been scrubbed in gas scrubber 7 is fractionated in low-temperature fractionator 8 into hydrogen, Substitute Natural Gas (SNG), ethane, and Liquefied Petroleum Gas (LPG). This proceeds in three steps. First, the gas is precooled and dried. Then, it is intermittently deep cooled and the hydrogen is obtained in excess of the required 80% purity for hydrogenation. After that, the liquefied hydrocarbons are distilled into the desired fractions.

The acid gas stream of the hydrogen sulfide desorber is introduced into an alkali metal hydroxide bath. This produces the corresponding hydrogen sulfide which is then brought to the grinder.

Any excess hydrogen sulfide is fed into a Claus system in order to produce pure sulfur. The hydrogen sulfide is burned with a stoichiometric quantity of oxygen to favor the production of elemental sulfur. It has been found that about 70% of the hydrogen sulfide is converted directly thereto. The gas leaving the combustion chamber contains mostly hydrogen sulfide and some sulfur dioxide. This mixture is subjected to several successive catalyst contact stages at temperatures of 350° to 190° C. and, as a result, is converted almost completely to sulfur. After each contact stage, the gas is cooled and the sulfur which has been formed condensed out.

In the atmospheric distillation step, a gas phase is also obtained. This phase, together with the gas stream from the precipitator, goes to gas scrubber 7. There, as previously set forth in greater detail, the hydrogen sulfide and carbon dioxide are washed out and the resultant purified gas is put through low temperature separator 8.

EXAMPLE

In a coal liquefaction plant, 208 metric tons per hour (5,000 tons per day) of moisture and ash free coal are introduced into the process. The coal contains approximately 0.1% by weight of chlorine and the neutralization of the resulting ammonium chloride would require 229 kilograms per hour of sodium sulfide. This neutralization would result in 100 kilograms per hour of hydrogen sulfide, which would have to be converted to pure sulfur in a Claus system.

When using sodium hydrogen sulfide of the present invention, 329 kilograms per hour would be required and 200 kilograms per hour of hydrogen sulfide are obtained. This is sufficient to produce the needed sodium hydrogen sulfide from sodium hydroxide. Advantageously, the burden on the Claus system is obviated. The excess sodium hydrogen sulfide, which is basically highly desirable if not necessary, can be produced from the hydrogen sulfide formed from the sulfur content of the coal during the hydrogenation step.

While only a limited number of specific embodiments of the present invention have been expressly described, it is, nonetheless, to be broadly construed and not to be limited except by the character of the claims appended hereto.

What we claim is:

1. In a method for the liquefaction of coal having chlorine-containing compounds comprising hydrogenation of said coal in the presence of a catalyst, the improvement which comprises neutralizing said compounds with alkali metal hydrogen sulfide whereby $H_2S$ is produced.

2. The method of claim 1 wherein said $H_2S$ is reacted with alkali metal hydroxide to produce said alkali metal hydrogen sulfide.

3. The method of claim 2 wherein said alkali metal hydrogen sulfide is introduced into said hydrogenation.

4. The method of claim 1 wherein said alkali metal is sodium or potassium.

5. The method of claim 1 wherein said metal is sodium.

6. The method of claim 1 wherein said coal is anthracite.

7. The method of claim 2 wherein said alkali metal is sodium or potassium.

8. The method of claim 2 wherein said alkali metal is sodium.

* * * * *